US006502592B2

(12) United States Patent
Chen

(10) Patent No.: US 6,502,592 B2
(45) Date of Patent: Jan. 7, 2003

(54) UMBRELLA STRUCTURE FOR RELEASING WIND

(76) Inventor: Chao Hui Chen, No. 81, Lane 2, Sec. 1, Chunghwa Road, Hsinchu (TW)

( * ) Notice: Subject to any disclaimer, the term of this patent is extended or adjusted under 35 U.S.C. 154(b) by 24 days.

(21) Appl. No.: 09/803,033

(22) Filed: Mar. 12, 2001

(65) Prior Publication Data

US 2002/0124876 A1 Sep. 12, 2002

(51) Int. Cl.[7] ..... A45B 25/20
(52) U.S. Cl. ..... 135/33.7; 135/33.2; 135/29
(58) Field of Search ..... 135/33.2, 16, 37, 135/29, 32, 33.5, 33.7, 15.1, 31

(56) References Cited

U.S. PATENT DOCUMENTS 5,078,166 A * 1/1992 Lee ..... 135/33.7
6,006,769 A * 12/1999 Lin ..... 135/33.7
6,336,464 B1 * 1/2002 Ko ..... 135/33.7

FOREIGN PATENT DOCUMENTS

JP 11-332624 * 12/1999 ..... 135/33.7

* cited by examiner

*Primary Examiner*—Lanna Mai
(74) *Attorney, Agent, or Firm*—Rosenberg, Klein & Lee

(57) ABSTRACT

The present invention relates to an umbrella structure for releasing wind and includes a supporting rib pivotally connected with a main rib of the umbrella at a middle position. The supporting rib is provided inside with a coil spring and an end ball for connecting with the outer circumscription of the upper umbrella cover while the lower cover being on the main rib from the connecting position of the main rib and a branch rib extending outward. The assembled umbrella includes two layers of cover wherein the upper cover is elastically connected by the supporting rib for a better connection and a perfect effect for releasing the heavy wind.

2 Claims, 5 Drawing Sheets

UMBRELLA STRUCTURE FOR RELEASING WIND

BACKGROUND OF THE INVENTION

A conventional large umbrella, such as a beach umbrella or an outdoor used umbrella, includes two layers of umbrella cover. When the heavy wind blows, it can be released from the space between the two covers. So this prevents the umbrella from being blown down or broken because of the ribs being inverted upward. The known umbrella includes two frames to connect with related covers and connecting ribs to control the opening and closing of the umbrella. The assembly of the prior structure is somehow complex and is heavy in total weight. It is inconvenient to use and in storage.

Accordingly, the primary object of the present invention is to provide an improved umbrella for releasing wind, which includes a single frame with a supporting rib to connect with the upper cover. It provides a simple assembly to obtain the predicted effect and improvement. Now the features and advantages of the present invention will be described in detail with reference to the accompanying drawings.

BRIEF DESCRIPTION OF ACCOMPANYING DRAWINGS

DETAILED DESCRIPTION OF PREFERRED EMBODIMENTS

Figure 1:
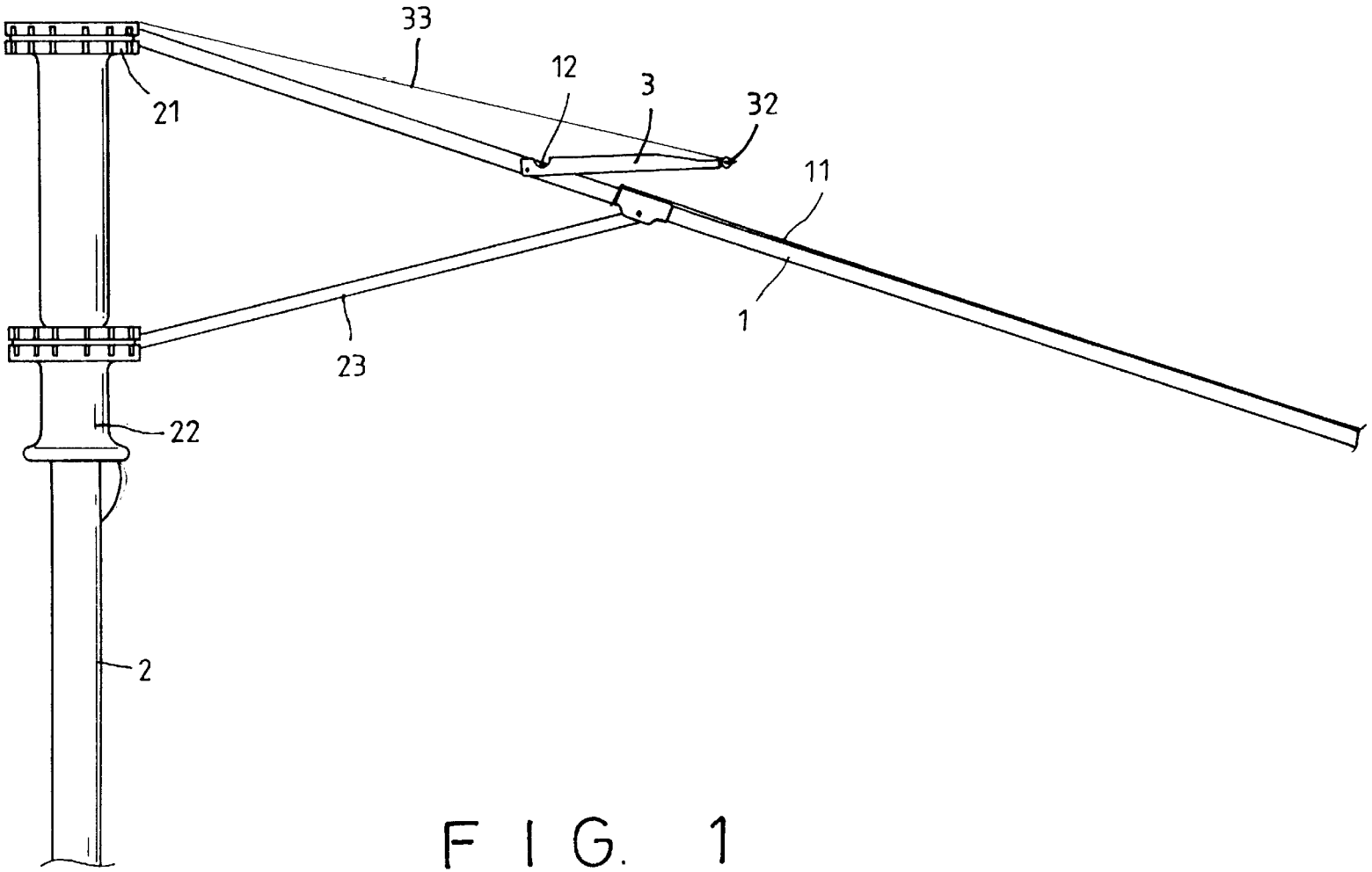
FIG. 1 is a plan view of a large umbrella in opened state according to the present invention.
Figure 2:
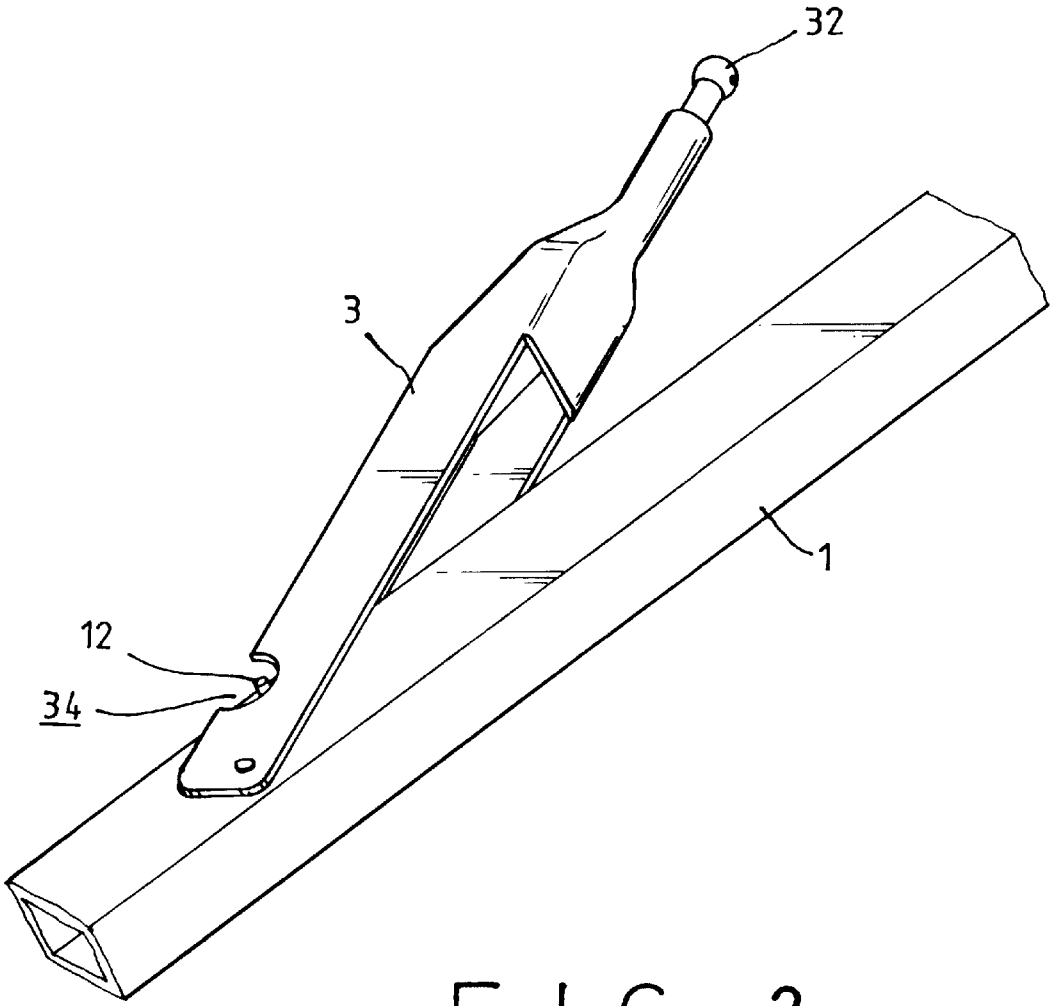
FIG. 2 is a perspective view of parts of FIG. 1 showing a supporting rib according to the present invention.
Figure 3:
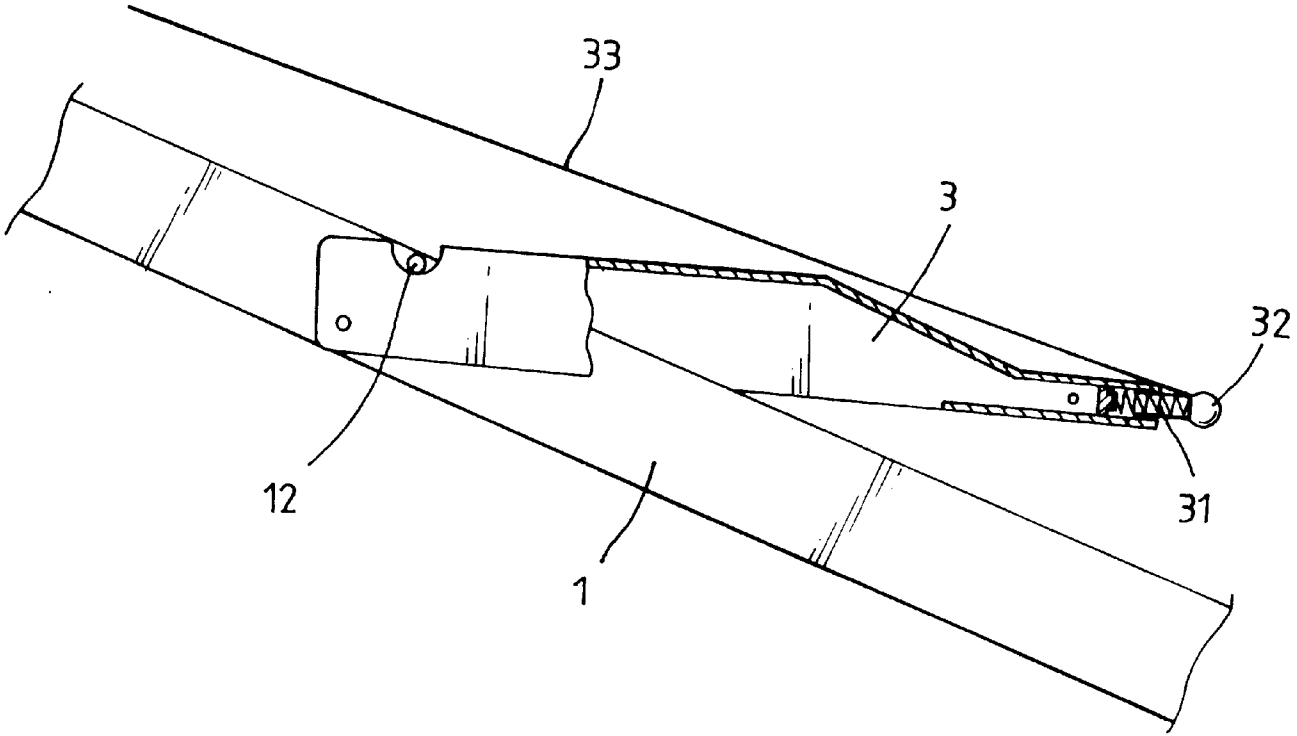
FIG. 3 is a partly cross-sectional plan view of FIG. 2.

Referring to FIGS. 1 to 3 first, the present invention is to provide a large umbrella for releasing wind, which includes a shaft (2) having a notch (21) and a runner (22) around the shaft (2). The main rib (1) has its inner end to connect with the notch (21) and the outer end extending outward. The branch rib (23) has its inner end to connect with the runner (22) and its outer end pivotally connecting onto a middle portion of the main rib (1) that becomes a single frame to provide a convenient use of the umbrella. The characteristic of the present invention is to provide a supporting rib (3) on the main rib (1) at an upper middle position. A coil spring (31) is provided inside the outer end of the supporting rib (3) and an end ball (32) is connected with the outer end of the coil spring (31). The supporting rib (3) has its inner side near the pivotal end formed in an arch-shaped groove (34), while a small pin (12) is mounted on the main rib (1) positioned in the groove (34). So the supporting rib (3) can swing in an adjusted angle range. An upper cover (33) covers the center of the frame and has its surrounding connected with the ball (32) of the supporting rib (3). A lower cover (11) has its inner circumscription jointed with the main rib (1) at a position where the branch rib (23) is connected with the main rib (1) and its outer circumscription with the outer end of the main rib (1).

After assembly, the position of the end ball (32) of the supporting rib (3) is farther from the notch (21) than the connecting position of branch rib (23) and the main rib (1). So the rain can be prevented from leaking into the umbrella according to this invention. Furthermore, the upper cover (33) is extended tense by the elastic force of the coil spring (31) in the supporting rib (3), which also provides a feature for the supporting rib (3) to swing up and the end ball (32) being flexible. The supporting rib (3) may function well without the coil spring depending on the type of fabrics. The supporting rib (3) swings up when the umbrella is open and down when the umbrella is packed. It is to be understood that the space between the two covers (11) and (33) provided by the supporting rib (3) is able to release the heavy wind and obtains a perfect effect of preventing from damage of the umbrella.

Figure 4:
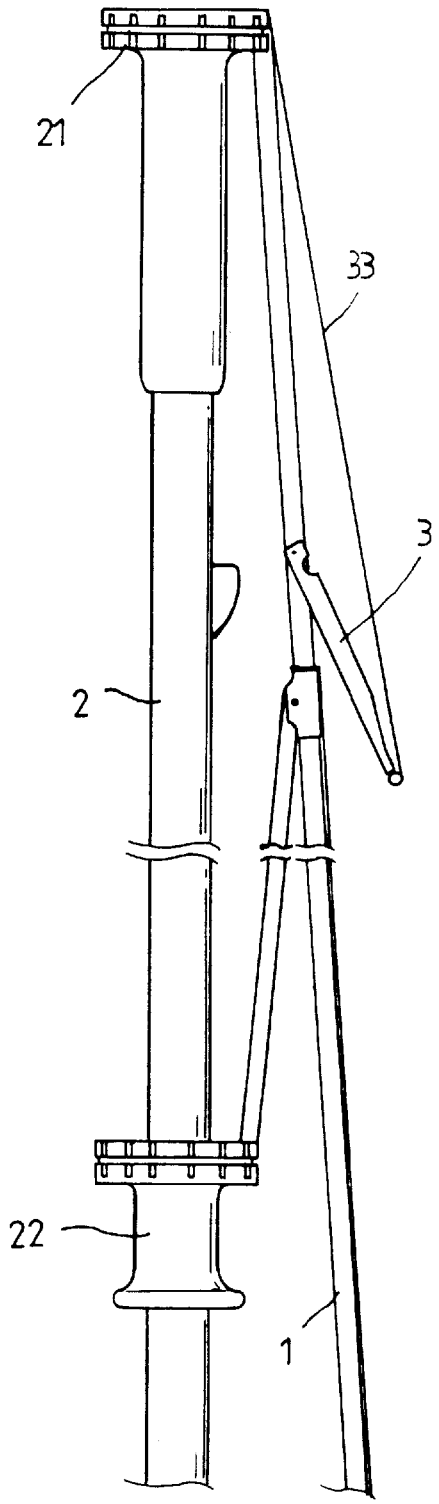
FIG. 4 is a plan view of FIG. 1 in closed state.
Figure 5:
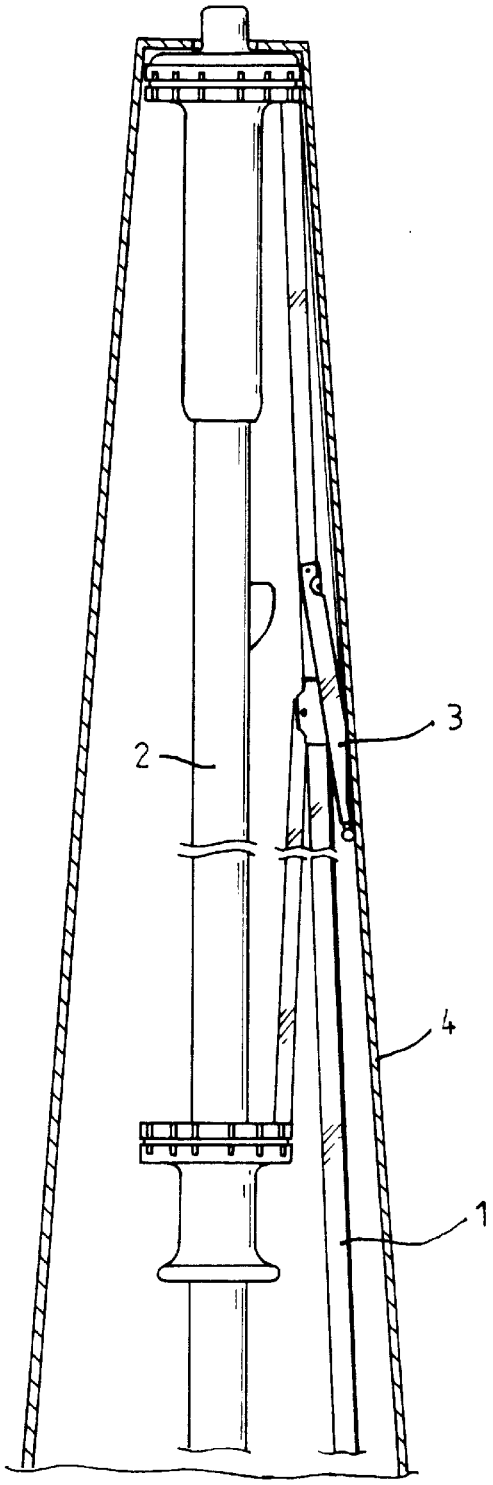
FIG. 5 is a plan view of FIG. 4 in storage according to the present invention.

Since the umbrella according to the present invention includes only a single frame, it can be closed easily as shown in FIG. 4, which overcomes the drawbacks of bulky closed volume and heavy weight of the prior known beach umbrella having two frames with two covers. As shown in FIG. 5, a plastic cone-shaped case (4) may be provided for receiving the closed umbrella of this invention to reduce the closed volume of the umbrella as the supporting rib (3) lightly resting on the main rib (1). Evidently the invention has the essence of a patent. We hereby apply for a patent grant.

What is claimed is:

1. An umbrella structure for releasing wind comprising:

a shaft having a notch and a runner around the shaft;

a main rib having an inner end connected to the notch and an outer end extending outwardly;

a branch rib having an inner end connected to the runner and an outer end pivotally connected to a middle portion of the main rib;

a supporting rib having an inner end pivotally connected to the main rib at an upper middle position thereof and a hollow outer end, the supporting rib having an arch-shaped groove formed in a side thereof adjacent the inner end of the supporting rib;

a coil spring disposed within the hollow outer end of the supporting rib;

an end ball connected with an outer end of the coil spring;

a small pin mounted on the main rib and positioned in the arch-shaped groove to enable the supporting rib to swing through a limited angle range;

an upper cover covering a central portion of the umbrella structure and having a perimeter portion thereof connected with the ball of the supporting rib; and, a lower cover having an inner circumscription joined with the main rib at a position where the branch rib is connected with the main rib and having an outer circumscription joined with the outer end of the main rib.

2. The umbrella structure for releasing wind as claimed in claim 1, wherein the upper cover is extended to be taut by an elastic force of the coil spring in the supporting rib acting on the end ball and thereby swinging the supporting rib upwardly when the umbrella is open for releasing a heavy wind.

* * * * *